United States Patent [19]

Yellow

[11] Patent Number: 5,039,443

[45] Date of Patent: Aug. 13, 1991

[54] AZEOTROPIC COMPOSITION OF 2,2-DICHLORO-1,1,1-TRIFLUOROETHANE AND METHANOL

[75] Inventor: Jasmine Yellow, Newark, Del.

[73] Assignee: E. I. Du Pont de Nemours and Company, Wilmington, Del.

[21] Appl. No.: 625,586

[22] Filed: Nov. 29, 1990

Related U.S. Application Data

[63] Continuation of Ser. No. 327,718, Mar. 23, 1989, abandoned.

[51] Int. Cl.[5] ..... C11D 7/30; C11D 7/50; C23G 5/028

[52] U.S. Cl. ..... 252/171; 134/12; 134/31; 134/38; 134/39; 134/40; 203/67; 252/162; 252/170; 252/364; 252/DIG. 9

[58] Field of Search ..... 570/118; 252/171, 172, 252/DIG. 9, 162, 170, 364; 134/12, 31, 38, 39, 40; 203/67

[56] References Cited

U.S. PATENT DOCUMENTS 4,816,175 3/1989 Lund ..... 252/171
4,816,176 3/1989 Lund ..... 252/171

FOREIGN PATENT DOCUMENTS 1-98699 4/1989 Japan .
1-152200 6/1989 Japan .

OTHER PUBLICATIONS

U.S. patent application Ser. No. 07/297,366 filed Jan. 17, 1988 (Case No. CH-1581).

*Primary Examiner*—Paul Lieberman
*Assistant Examiner*—Linda D. Skaling

[57] ABSTRACT

An azeotrope or azeotrope-like composition of 2,2-dichloro-1,1,1-trifluoroethane (HCFC-123) and methanol, the azeotropic mixture being useful in solvent cleaning application.

5 Claims, No Drawings

AZEOTROPIC COMPOSITION OF 2,2-DICHLORO-1,1,1-TRIFLUOROETHANE AND METHANOL

This application is a continuation of application Ser. No. 07/327,718 filed 3/23/89 now abandoned.

BACKGROUND OF THE INVENTION

As modern electronic circuit boards evolve toward increased circuit and component densities, thorough cleaning of the boards after soldering becomes more important. Generally, current industrial processes for soldering electronic components to circuit boards involve coating the entire circuit side of the board with a flux and thereafter passing this coated side of the board over preheaters and through molten solder. The flux cleans the conductive metal parts and promotes solder fusion. Commonly used fluxes consist, for the most part, of rosin, either used alone or with activating additives, such as amine hydrochlorides or oxalic acid derivatives.

After soldering, which thermally degrades part of the rosin, the remaining flux and flux-residues are often removed from the circuit boards with a heated organic solvent. The requirements for such solvents are very stringent. Defluxing solvents should have the following characteristics: be low boiling, be nonflammable, have low toxicity and high solvency power so that flux and flux-residues can be removed without damaging the substrate being cleaned.

While boiling temperature, flammability and solvent power characteristics can often be adjusted by mixing different solvents together, the mixtures that are formed are often unsatisfactory because they fractionate to an undesirable degree on boiling while in use. The more volatile components of these mixtures vaporize first, causing the boiling mixtures to continuously change in both composition and boiling temperature. This fractionation is undesirable since it could result in altered solvency properties. The fractionation also makes it virtually impossible to recover and reuse a solvent mixture with the original composition.

On the other hand, an azeotropic mixture gives off vapor which has the same composition as the mixture. Since there is no preferential vaporization of the components, azeotropic mixtures remain constant boiling throughout distillation. In vapor-degreasing operations, this constant boiling aspect of azeotropic mixtures is desirable since the solvent vapor can be condensed back into a mixture with its original composition and then be used for the final rinse. Thus, vapor defluxing and degreasing systems act as a still. Unless the solvent composition exhibits a constant boiling point, i.e., is a single material, an azeotrope or is azeotrope-like, fractionation will occur and undesirable solvent distributions will result which could detrimentally affect the safety and efficacy of the cleaning operation.

Unfortunately, as recognized in the art, it is not possible to predict the formation of azeotropes. This fact obviously complicates the search for new azeotropic compositions which have application in the field. Nevertheless, there is a constant effort in the art to discover new azeotropes or azeotrope-like compositions which have improved solvency characteristics and particularly greater versatility in solvency power.

SUMMARY OF THE INVENTION

According to the present invention, an azeotrope or azeotrope-like composition has been discovered comprising an admixture of an effective amounts of 2,2-dichloro-1,1,1-trifluoroethane and methanol. More specifically, the azeotrope or azeotrope-like compositions comprises about 97–99 weight percent 2,2-dichloro-1,1,1-trifluoroethane and about 1–3 weight percent methanol.

The present invention provides a nonflammable azeotropic composition which is well suited for solvent cleaning applications.

DETAILED DESCRIPTION OF THE INVENTION

The composition of the instant invention comprises an admixture of effective amounts of 2,2-dichloro-1,1,1-trifluoroethane ($CHCl_2CF_3$, boiling point=27.9° C.) and methanol ($CH_3OH$, boiling point=65.0° C.) to form an azeotrope or azeotrope-like mixture. The fluorinated compound is also known as HCFC-123, in the nomenclature conventional to the chlorofluorocarbon field.

By azeotrope or azeotrope-like composition is meant a constant boiling liquid admixture of two or more substances, which admixture behaves like a single substance in that the vapor, produced by partial evaporation or distillation of the liquid, has substantially the same composition as the liquid, i.e., the admixture distills without substantial change in composition. Constant boiling compositions, which are characterized as azeotropes or azeotrope-like, exhibit either a maximum or minimum boiling point as compared with that of the non-azeotropic mixtures of the same substances.

For purposes of this invention, effective amount is defined as the amount of each component of the instant invention admixture which, when combined, results in the formation of the azeotrope or azeotrope-like compositions of the instant invention. This definition includes the amounts of each component, which amounts may vary depending upon the pressure applied to the composition so long as the azeotrope or azeotrope-like compositions continue to exist at the different pressures, but with possible different boiling points. Therefore, effective amount includes the weight percentages of each component of the compositions of the instant invention which form azeotrope or azeotrope-like compositions at pressures other than atmospheric pressure. When the pressure applied to these compositions is adjusted to atmospheric pressure, i.e., 760 mm Hg, these compositions will contain the azeotrope of the instant invention which will boil at the atmospheric boiling point for the true azeotrope described herein.

It is possible to fingerprint, in effect, a constant boiling admixture which may appear under many guises, depending upon the conditions chosen, by any of several criteria:

The composition can be defined as an azeotrope of A, B, C, (and D . . . ) since the very term "azeotrope" is at once both definitive and limitative, and requires that effective amounts of A, B, C (and D . . . ) form this unique composition of matter which is a constant boiling admixture.

It is well known by those skilled in the art that, at different pressures, the composition of a given azeotrope will vary at least to some degree, and changes in pressure will also change, at least to some degree, the boiling point temperature. Thus an azeotrope of A, B, C (and D . . . ) represents a unique type of relationship but with a variable composition which depends on temperature and/or pressure. Therefore, compositional ranges, rather than fixed compositions, are often used to define azeotropes.

The composition can be defined as a particular weight percent relationship or mole percent relationship of A, B, C (and D . . . ), while recognizing that such specific values point out only one particular such relationship and that in actuality, a series of such relationships, represented by A, B, C (and D . . . ) actually exist for a given azeotrope, varied by the influence of pressure.

An azeotrope of A, B, C (and D . . . ) can be characterized by defining the composition as an azeotrope characterized by a boiling point at a given pressure, thus giving identifying characteristics without unduly limiting the scope of the invention by a specific numerical composition, which is limited by and is only as accurate as the analytical equipment available.

Binary mixtures of about 97–99.5 weight percent HCFC-123 and about 0.5–3 weight percent methanol are characterized as azeotropes or azeotrope-like in that mixtures within this range exhibit a substantially constant boiling point at constant pressure. Being substantially constant boiling, the mixtures do not tend to fractionate to any great extent upon evaporation. After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true binary azeotrope.

The binary composition consisting of about 98.8 weight percent HCFC-123, and about 1.2 weight percent methanol has been established, within the accuracy of the fractional distillation method, as a true binary azeotrope, boiling at about 28° C., at substantially atmospheric pressure and is preferred.

The HCFC-123 of the instant invention may contain minor amounts of HCFC-123a.

The azeotrope of the present invention permits easy recovery and reuse of the solvent from vapor defluxing and degreasing operations because of its azeotropic nature. As an example, the azeotropic mixture of this invention can be used in cleaning processes such as described in U.S. Pat. No. 3,881,949, which is incorporated herein by reference.

The azeotrope of the instant invention can be prepared by any convenient method including mixing or combining the desired component amounts. A preferred method is to weigh the desired component amounts and thereafter combine them in an appropriate container.

EXAMPLE 1

A sample of HCFC-123 was placed in a glass flask equipped with a reflux condenser and brought to a boil. Small amounts of methanol were incrementally added to the boiling HCFC-123 to form a refluxing mixture of changing composition. The boiling temperature of this mixture was found to first decrease when methanol was initially added and then increase when the methanol concentration of the mixture exceeded 1.2 weight percent, forming a minimum boiling point of 27.6° C. at the composition of 98.8 weight percent HCFC-123 and 1.2 weight percent methanol. The data for this distillation are shown in Table 1.

The existence of the minimum boiling point indicated the formation of an azeotrope between HCFC-123 and methanol with the above composition.

TABLE 1

Additional Distillation of HCFC-123 and Methanol

| Wt. % HCHF-123 | Wt. % Methanol | Corrected Boiling Point Temp. °C. |
|---|---|---|
| 100.0 | 0 | 27.90 |
| 99.8 | 0.2 | 27.87 |
| 99.7 | 0.3 | 27.78 |
| 99.5 | 0.5 | 27.72 |
| 99.4 | 0.6 | 27.69 |
| 99.2 | 0.8 | 27.64 |
| 99.1 | 0.9 | 27.60 |
| 98.8 | 1.2 | 27.57 |
| 98.6 | 1.4 | 27.58 |
| 98.5 | 1.5 | 27.62 |
| 98.3 | 1.7 | 27.62 |
| 98.2 | 1.8 | 27.63 |
| 98.0 | 2.0 | 27.62 |
| 97.7 | 2.3 | 27.69 |
| 97.1 | 2.9 | 27.75 |
| 96.3 | 3.7 | 27.85 |
| 95.3 | 4.7 | 27.92 |
| 92.8 | 7.2 | 28.06 |

EXAMPLE 2

A solution containing 98.8 weight percent HCFC-123 and 1.2 weight percent methanol was prepared in a suitable container and mixed thoroughly. This solution was distilled in a glass distillation apparatus equipped with a Claisen-Vigeraux distillation head. The boiling temperature of this solution remained essentially constant at an uncorrected 27.5° C. for the most part of the distillation as shown by the data in Table 2.

The constant-boiling character of the solution was consistent with the distillation characteristics of an azeotrope or azeotrope-like composition.

TABLE 2

Fractional Distillation of HCFC-123/Methanol Azeotrope
Ambient Conditions: Barometer - 760.5 mm Hg
Temperature - 23.4° C.

| Distillate Volume % | Boiling Point, °C. |
|---|---|
| 0 | 21.8 |
| 1 | 27.0 |
| 4 | 27.3 |
| 7 | 27.3 |
| 10 | 27.3 |
| 13 | 27.3 |
| 16 | 27.4 |
| 18 | 27.4 |
| 23 | 27.4 |
| 27 | 27.5 |
| 33 | 27.5 |
| 37 | 27.5 |
| 42 | 27.5 |
| 46 | 27.5 |
| 50 | 27.5 |
| 55 | 27.5 |
| 60 | 27.5 |
| 64 | 27.5 |
| 70 | 27.5 |
| 73 | 27.5 |
| 78 | 27.5 |
| 80 | 27.5 |
| 84 | 27.5 |
| 87 | 27.5 |
| 90 | 27.5 |
| 92 | 27.5 |
| 96 | 27.5 |

EXAMPLE 3

A solution containing 50.0 weight percent HCFC-123 and 50.0 weight percent methanol was prepared in a suitable container and mixed thoroughly. This solution was distilled in a glass distillation apparatus equipped with a Claisen-Vigeraux distillation head.

Since the solution was rich in methanol, when distilled it was expected to boil off the HCFC-123/methanol azeotrope first and then the excess methanol when HCFC-123 became exhausted. Gas chromotographic analyses of the incrementally pooled distillate verified that the composition of the minimum boiling first-distillates contained 1.0–1.8 weight percent methanol and 99.0–98.2 weight percent HCFC-123, affirming the existence and the composition of the azeotrope. The date are listed in Table 3.

TABLE 3

Fractional Distillation of a Mixture of HCFC-123 & Methanol (1:1 by wt.)
Ambient Conditions: Barometer - 762.9 mm Hg
Temperature - 22.7° C.

| Distillate Volume % | Vapor Phase Temp. °C. | | Distillate Composition wt. % Methanol | HCFC-123 |
|---|---|---|---|---|
| 0.4 | 27.0 | | | |
| 1.0 | 28.0 | pooled 4 ml sample | 1.8 | 98.2 |
| 1.4 | 28.3 | | | |
| 2.0 | 28.5 | | | |
| 4.0 | 28.7 | | | |
| 5.0 | — | | | |
| 6.0 | 28.3 | | | |
| 8.0 | 28.3 | | | |
| 9.0 | 28.5 | | | |
| 11.0 | 28.7 | pooled 4 ml sample | 1.0 | 99.0 |
| 13.0 | 28.5 | | | |
| 14.0 | — | | | |

TABLE 3-continued

Fractional Distillation of a Mixture of HCFC-123 & Methanol (1:1 by wt.)
Ambient Conditions: Barometer - 762.9 mm Hg
Temperature - 22.7° C.

| Distillate Volume % | Vapor Phase Temp. °C. | | Distillate Composition wt. % Methanol | HCFC-123 |
|---|---|---|---|---|
| 15.0 | 29.0 | | | |
| 19.0 | 31.0 | | | |
| 21.0 | 33.3 | pooled 4 ml sample | 4.2 | 95.8 |
| 24.0 | — | | | |
| 33.0 | 58.3 | pooled 4 ml sample | 23.1 | 76.9 |
| 34.0 | — | | | |
| . | | | | |
| . | | | | |
| . | | | | |
| 63.0 | 64.9 | pooled 4 ml sample | 99.8 | 0.2 |
| 64.0 | — | | | |
| 83.0 | 64.9 | pooled 4 ml sample | 100.0 | 0 |
| 84.0 | — | | | |

I claim:

1. An azeotrope or azeotrope-like composition consisting essentially of about 97–99.5 weight percent 2,2-dichloro-1,1,1-trifluoroethane and about 0.5–3 weight percent methanol, said composition having a boiling point of about 28° C. at substantially atmospheric pressure.

2. The azeotrope or azeotrope-like composition of claim 1, wherein the composition is about 98.8 weight percent 2,2-dichloro-1,1,1-trifluoroethane and about 1.2 weight percent methanol.

3. A process for cleaning a solid surface which comprises treating said surface with the azeotrope or azeotrope-like composition of claim 1.

4. The process of claim 3 wherein the solid surface is a printed circuit board contaminated with flux and flux-residues.

5. The process of claim 3 wherein the solid surface is a metal.

* * * * *

UNITED STATES PATENT AND TRADEMARK OFFICE

CERTIFICATE OF CORRECTION

PATENT NO. : 5,039,443

DATED : August 13, 1991

INVENTOR(S) : Jasmine Yellow

It is certified that error appears in the above-identified patent and that said Letters Patent is hereby corrected as shown below:

COLUMN 6:

Claim 1, line 25, delete the term "azeotrope or".

Claim 2, lines 31-32, delete "The azeotrope of azeotrope-like composition of claim 1, wherein the composition is" should read --An azeotrope composition consisting essentially of--.

Claim 2, line 34, after "methanol" insert --, said composition having a boiling point of about 27.6° C at substantially atmospheric pressure--.

Claim 3, line 37, after "Claim 1" insert --or Claim 3--.

Signed and Sealed this

Eighth Day of December, 1992

*Attest:*

DOUGLAS B. COMER

*Attesting Officer*

*Acting Commissioner of Patents and Trademarks*